US005444926A

United States Patent [19]

Allen et al.

[11] Patent Number: 5,444,926

[45] Date of Patent: Aug. 29, 1995

[54] REACTIVE ENERGY APPARATUS PROVIDING CUSHIONING AND A CUSTOM FIT AT THE INSTEP AREA OF A SHOE UPPER AND THE FOREFOOT AREA OF THE SHOE SOLE

[75] Inventors: Bernie Allen, Wayland; Christopher J. Edington, Derry, N.H.; Eric Swartz, Wilmington, Mass.; Rui Parracho, Peabody, Mass.; Richard Mochen, Milton, Mass.

[73] Assignee: Converse Inc., North Reading, Mass.

[21] Appl. No.: 195,489

[22] Filed: Feb. 14, 1994

Related U.S. Application Data

[63] Continuation of Ser. No. 952,297, Sep. 28, 1992, abandoned.

[51] Int. Cl.[6] ..... A43B 7/14

[52] U.S. Cl. ..... 36/93; 36/54; 36/29

[58] Field of Search ..... 36/93, 88, 28, 29, 71, 36/153, 35 B, 54, 55, 114, 25 R, 45, 3 R, 3 A, 3 B

[56] References Cited

U.S. PATENT DOCUMENTS

| | | | |
|---|---|---|---|
| 2,365,807 | 12/1944 | Dialynas | 36/153 |
| 3,854,228 | 12/1974 | Conroy | 36/71 |
| 4,144,658 | 3/1979 | Swan, Jr. | 36/71 |
| 4,227,320 | 10/1980 | Borgeas | 36/29 |
| 4,229,546 | 10/1980 | Swan, Jr. | 36/93 |
| 4,662,087 | 5/1987 | Beuch | 36/93 |
| 4,744,157 | 5/1988 | Dubner | 36/71 |
| 4,768,295 | 9/1988 | Ito | 36/28 |
| 5,113,599 | 5/1992 | Cohen et al. | 36/88 |
| 5,155,927 | 10/1992 | Bates | 36/71 |
| 5,158,767 | 10/1992 | Cohen et al. | 36/29 |

*Primary Examiner*—Steven N. Meyers
*Assistant Examiner*—Thomas P. Hilliard
*Attorney, Agent, or Firm*—Rogers, Howell & Haferkamp

[57] ABSTRACT

The present invention relates to a fluid filled apparatus that reacts with the stimulus of outside forces, furnished at the instep area of a shoe upper and the forefoot area of the shoe sole. The apparatus provides cushioning and a custom fit to the shoe in an area surrounding the forward portion of the shoe wearer's foot. In particular, the present invention pertains to a reactive energy apparatus comprised of anatomically shaped fluid filled bladders or pads that are furnished at the instep area of the shoe upper and the forefoot area of the shoe sole. The bladders engage and assume a complimentary custom fitting configuration around the instep and ball of the shoe wearer's foot by displacement of fluid contained in the bladders, and thereby provide cushioning and a custom fit around the shoe wearer's foot.

17 Claims, 1 Drawing Sheet

REACTIVE ENERGY APPARATUS PROVIDING CUSHIONING AND A CUSTOM FIT AT THE INSTEP AREA OF A SHOE UPPER AND THE FOREFOOT AREA OF THE SHOE SOLE

This is a continuation of application Ser. No. 07/952,297 filed on Sep. 28, 1992 now abandoned.

BACKGROUND OF THE INVENTION (1) Field of the Invention

The present invention relates to a fluid filled apparatus that reacts with the stimulus of outside forces, hereinafter referred to as a reactive energy apparatus, furnished at the instep area of a shoe upper and the forefoot area of the shoe sole. The reactive energy apparatus provides cushioning and a custom fit to the shoe in an area surrounding the forward portion of the shoe wearer's foot. In particular, the present invention pertains to a reactive energy apparatus comprised of anatomically shaped fluid filled bladders or pads that are furnished at the instep area of the shoe upper and the forefoot area of the shoe sole. The bladders engage and assume a complimentary custom fitting configuration around the instep and ball of the shoe wearer's foot by displacement of fluid contained in the bladders, and thereby provide cushioning and a custom fit around the shoe wearer's foot.

(2) Description of the Related Art

Various methods and devices have been employed in the prior art seeking to develop a shoe that provides a cushioned custom fit around the foot of the shoe wearer regardless of the size or shape of the foot. One method of matching a shoe's construction to the particular size and shape of the foot of the shoe wearer is to construct the shoe specifically dimensioned to comfortably fit the shoe wearer's foot. However, this method is disadvantaged in that the costs for producing the shoe are considerable and tailor made shoes are not affordable to the general public.

Many prior art shoes are designed with a certain amount of cushioning in the sole and sidewalls of the shoe upper to both compensate for variations in the size and shape of feet as well as providing cushioning to absorb the shock of footstep impact in walking, running and other activities. However, this approach has been found to be disadvantaged in that, after a period of use the cushioning becomes matted or compressed and no longer provides a snug custom fit around the foot of the shoe wearer. This is evident in shoes having uppers constructed of a flexible or stretchable material. When the shoe is first secured on the wearer's foot, the cushioning of the shoe provides a comfortable, snug fit along the sole of the foot and across the top of the foot instep. As the shoe is worn while walking, running or during other activities, the flexing of the foot in the shoe compresses the cushioning of the sole and instep area of the shoe upper while also stretching the material of the shoe upper. After a period of use, the shoe which fit snug over the foot when first put on the foot now fits loose over the foot and no longer provides the cushioning and support to the foot as it did when first secured on the foot.

What is needed to overcome the above described disadvantages of prior art shoes is a reactive energy apparatus that is dynamically reactive to provide a continuous supporting and comfortable fit of both the shoe sole and shoe upper around the foot of a wearer as the foot moves and flexes while wearing the shoe.

SUMMARY OF THE INVENTION

The present invention satisfies the needs of the prior art by providing a reactive energy apparatus in a shoe upper and sole that enables the shoe to provide a supporting, cushioned custom fit to the instep area and the sole of the shoe wearers foot, where the degree of cushioning and custom fit is continuously changing as the foot moves and flexes in the shoe. In the upper instep/-forefoot area of the foot, shoe fit is particularly important in controlling foot pronation and supination (and providing support) in athletic activities involving substantial lateral movements, for example basketball and tennis. The top of the instep is a very sensitive area of the foot, especially for athletes having high insteps and/or arches and those that prefer a tight shoe fit. The forefoot of shoes are typically very thin. The present invention provides increased cushioning in this area of the shoe to help bring the foot to a gradual stop during lateral foot movements and in running or jumping where an individual can land with a force as much or more than ten times their body weight.

The reactive energy apparatus of the present invention is generally comprised of a plurality of fluid filled bladders or pads provided at the upper portion of a shoe and the sole of the shoe. A first bladder of the plurality of fluid filled bladders is provided in the quarter, tongue and vamp areas of the shoe upper. Another of the plurality of bladders is provided in the area of the shoe sole below the shoe wearers forefoot. The two bladders are connected in fluid communication by a fluid conducting conduit that extends between the bladders and around the side of the wearers foot. The conduit has a cross section dimensioned to control the rate of fluid flow between the two bladders, thereby maintaining some residual cushioning fluid in the one of the two bladders subjected to internal and external forces due to movement of the shoe wearers foot in the shoe. The fluid conducting conduit extends through a protective sleeve provided at the side of the shoe upper that prevents the conduit from being collapsed or pressed closed by movement of the foot in the shoe. The fluid contained in each of the bladders and the ability of the fluid to flow through the conduit between the bladders enables the bladders to assume an anatomical shape complimentary to the shape of the shoe wearers instep and sole. The conforming shape of the bladders to the foot provides a cushioning custom fit of the shoe on the wearers foot, and also provides support to the foot as the foot moves and flexes in the shoe.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

Figure 1:
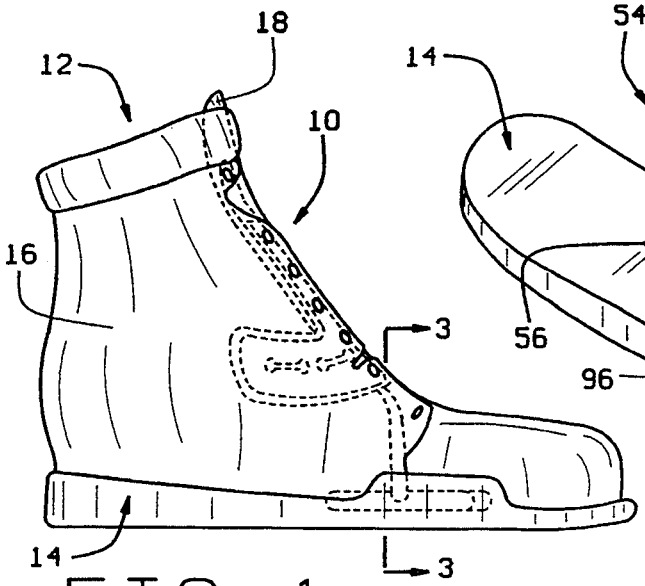
FIG. 1 is a side elevation view of an athletic shoe incorporating the reactive energy apparatus of the present invention showing the relative positions of the apparatus in phantom lines at the upper portion of the shoe and the shoe sole.

The reactive energy apparatus 10 of the present invention is shown is one embodiment of the apparatus in FIG. 1. In the embodiment of the invention shown in FIG. 1, the apparatus 10 is employed in an athletic shoe 12. The shoe 12 is generally comprised of a shoe sole 14 and a shoe upper 16, the upper including the shoe tongue 18. The apparatus of the invention 10 is shown in the drawing figures employed in only one shoe. However, the assembly of the apparatus in the shoe shown in the drawing figures is substantially identical for both left and right foot shoes. Although the apparatus is shown and described herein as employed in an athletic shoe, the apparatus of the invention is equally well suited for use in shoes other than the athletic shoe shown and its description of being employed with an athletic shoe is illustrative only and should not be interpreted as limiting.

Figure 4:
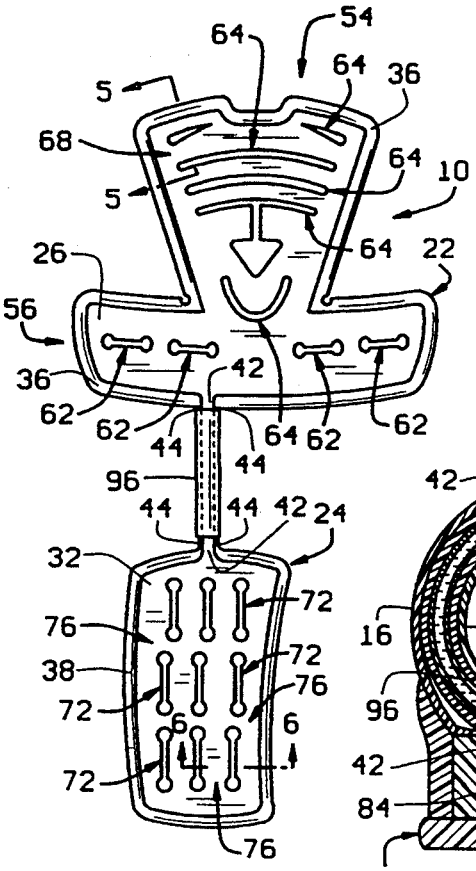
FIG. 4 is a plan view of the apparatus of the invention removed from the shoe.
Figure 6:
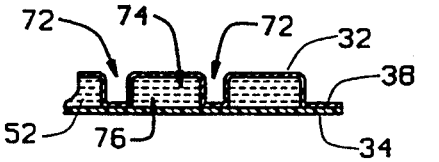
FIG. 6 is a partial elevation view, in cross section, of the apparatus of the invention taken along the line 6—6 of FIG. 4.

The apparatus 10 is shown separated from the shoe in FIG. 4. As seen in FIG. 4, the reactive energy apparatus 10 of the present invention is comprised of a first fluid containing pad or bladder 22 that is located at the tongue and vamp areas or the instep area of the shoe upper, and a second fluid containing pad or bladder 24 that is located at the forefoot area of the shoe sole. Each of the two bladders may be constructed with one or more interior chambers containing a fluid. In the embodiment of the invention to be described, only the tongue bladder 22 is comprised of two interior chambers. The forefoot bladder 24 is constructed having a single fluid filled interior chamber. The apparatus 10 is constructed from a flexible, fluid tight barrier material, preferably a plastic-type film that is capable of being bonded such as polyurethane. Although polyurethane is preferred, other types of flexible, fluid tight barrier materials may be employed in constructing the apparatus of the invention without departing from the intended scope of the invention defined by the claims.

The two hollow bladders 22, 24 are formed as component parts of a single unit of the apparatus 10, with each of the bladders being constructed from tongue bladder sections and forefoot bladder sections of a pair of overlapping layers 26, 28, 32, 34 of a flexible, fluid tight barrier material, respectively. As is best seen in FIG. 4, the overlapping tongue bladder sections 26, 28 of the material layers have a peripheral boundary 36 that is formed in a specific configuration to give the tongue bladder an anatomically-shaped outline that is complimentary to the instep area of a foot. In a like manner, the overlapping forefoot bladder sections 32, 34 of the material layers have a peripheral boundary 38 that is formed in a specific configuration to give the forefoot bladder of the apparatus an anatomically-shaped outline that is complimentary to the forefoot area of the bottom of the foot. The tongue section 26 and forefoot section 32 of the top layer of barrier material has a predetermined surface configuration molded into it, where the tongue and forefoot sections 28, 34 of the bottom layer of barrier material are substantially flat. The configurations of the shapes molded into the tongue and forefoot sections 26, 32 of the top material layer form the tongue bladder 22 and forefoot bladder 24 and a fluid conducting channel 42 communicating the interior volume of the tongue bladder 22 with the interior volume of the forefoot bladder 24.

Both the tongue bladder 22 and forefoot bladder 24, as well as the fluid conducting channel 42, are formed when the top layer of barrier material is secured to the bottom layer in the relative positions of the two layers shown in the drawing figures. The molded configurations formed in the first and second sections 26, 32 of the top layer of barrier material serve as flexible sidewalls or surfaces of each of the tongue and forefoot bladders. The configurations may be molded into the tongue and forefoot sections of the top layer of barrier material by any known method. The particular configurations of the tongue and forefoot bladders shown in the drawing figures enable the apparatus to cushion a foot inserted into the shoe 12 employing the apparatus, and enable the shoe to provide a cushioned custom fit to the foot inserted in the shoe.

The overlapping tongue sections 26, 28 of the top and bottom layers of barrier material are sealed together along the peripheral flange 36 that completely surrounds and defines the boundaries of the tongue bladder 22. The overlapping forefoot sections of the top and bottom layers of barrier material 32, 34 are sealed together along the peripheral flange 38 that completely surrounds and defines the boundaries of the forefoot bladder 24. The overlapping conduit sections of the top and bottom layers of barrier material 42 are sealed together along the sections 44 of the peripheral flange that extend along the opposite sides of the conduit 42 between the tongue bladder 22 and forefoot bladder 24. Sealing the tongue, forefoot and conduit sections of the peripheral flange of the apparatus encloses the interior volumes of the tongue bladder 22, the forefoot bladder 24 and the fluid conducting channel 42 between the two material layers. The top and bottom layers of barrier material may be sealed together along the tongue flange 36, forefoot flange 38 and channel flanges 44 by adhesives, by radio frequency (RF) welding, or by other equivalent methods. The seal formed at the peripheral flanges is fluid tight and forms a completely enclosed interior volume in each of the two bladders and the fluid channel. Although the bladders, except for the tongue bladder 22, are described as enclosing one interior chamber, in variant embodiments of the invention both the tongue bladder 22 and forefoot bladder 24 may enclose two or more separate chambers that may or may not be interconnected in fluid communication with each other.

The overlapping areas of the pair of barrier material layers forming the sections 44 of the peripheral boundary 36 on opposite sides of the fluid conducting channel 42 not only form the fluid conducting channel 42 that communicates the interior volume of the tongue bladder 22 with the interior volume of the forefoot bladder 24, but also serve to calibrate or define a predetermined cross sectional area of the fluid conducting channel 42. The calibration of the cross section area of the channel 42 enables the channel to control the rate of fluid flow between the interior volumes of the tongue bladder 22 and forefoot bladder 24. The channel 42 is formed by the molded configuration of the top layer of material and the sections of the sealed peripheral flange 44 on the opposite sides of the channel. In variant embodiments of the invention, a flow control valve (not shown), such as a flow control orifice, may be positioned in the interior of the fluid conducting channel 42 to control the rate of fluid flow between the tongue bladder 22 and forefoot bladder 24.

Each of the bladders is filled with a moderately viscous fluid 52. Several different types of fluids may be employed as the fluid filling the bladders and the fluid conducting channel. The fluid could include a composition of two or more fluids having different viscosities or the fluid could include solids, including but not limited to hollow or solid spheres or particles suspended in the fluid as well as gas bubbles.

The tongue sections of the top and bottom layers 26, 28 of barrier material both have a peripheral boundary 36 cut in a specific configuration to form the tongue bladder 22 in two chambers, a tongue chamber 54 and a vamp or instep chamber 56. The configuration of the tongue chamber 54 of the tongue bladder 22 extends the chamber along the tongue 18 of the shoe 12 and upward across the instep surface of the shoe wearer's foot. The configuration of the vamp chamber 56 of the tongue bladder 22 extends the chamber around opposite sides of the instep area of the shoe wearer's foot and across the top of the foot at the instep area of the foot. The configurations of both the tongue chamber 54 and vamp chamber 56 of the tongue bladder 22 are also chosen to conform to the tongue 18 and vamp areas of the shoe 12, although this is a secondary consideration. The primary consideration in determining the configuration of the peripheral boundary 36 of the tongue and vamp chambers 54, 56 of the tongue bladder 22 is to extend the bladders over the instep area of the shoe wearer's foot and around opposite sides of the instep area of the shoe wearer's foot to provide a cushioned, custom fit of the shoe 12 at these areas of the foot.

Figure 5:
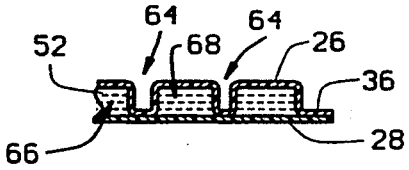
FIG. 5 is a partial elevation view, in cross section, of the apparatus of the invention taken along the line 5—5 of FIG. 4.

Pluralities of clefts 62 are formed in the top layer of barrier material covering the vamp chamber 56 of the tongue bladder 22. A second plurality of clefts 64 is also formed in the top layer of barrier material covering the tongue chamber 54 of the tongue bladder 22. In both pluralities of clefts 62, 64, the clefts are formed in the top layer of barrier material and extend downward into the interior volume 66 of the tongue bladder 22 to the bottom layer 28 of barrier material. As seen in drawing FIG. 5, each of the tongue bladder clefts are formed as indentations or depressions in the top layer 26 of barrier material. Each of the clefts have set lengths arranged end-to-end in a row extending laterally across the vamp chamber 56 of the tongue bladder 22, and are arranged side-by-side in a column extending longitudinally across the tongue chamber 54 of the tongue bladder 22. The depressions of both pluralities of clefts 62, 64 extend downward below the top layer 26 of barrier material, through the fluid 52 filling the interior volume 66 of the tongue bladder 22, and the bottoms of each of the clefts are secured to the bottom layer 28 of barrier material. The bottoms of the clefts may be sealed to the bottom layer of material by adhesives, by radio frequency welding, or by other equivalent methods.

By forming the clefts 62, 64 in the top layer 26 of the tongue bladder 22 in the manner described above, and by arranging the first plurality of clefts 62 in a row array extending laterally across the vamp chamber 56 of the bladder, and arranging the second plurality of clefts 64 in a column array extending longitudinally across the tongue chamber 54 of the tongue bladder, the first and second pluralities of clefts form lateral fold lines extending across the top layer 26 of the vamp chamber 56 and tongue chamber 54 of the tongue bladder 22. The fold lines formed by the clefts 62, 64 facilitate the folding or bending of the vamp and tongue chambers 56, 54 of the tongue bladder 22 along the fold lines formed by the clefts. This enables the tongue bladder 22 to be folded over at the cleft fold lines when the tongue 18 and vamp areas of the shoe are bent in putting the shoe on the wearer's foot and in walking, running or other activities.

In addition to forming lateral fold lines across the vamp and tongue chambers of the tongue bladder 22, the plurality of clefts 62, 64 form wall segments having opposite sides and opposite ends in the interior volume 66 of the tongue bladder. The wall segments formed by each of the clefts in the interior of the tongue bladder divide the interior volume into separate areas and secure the top layer 26 of barrier material to the bottom layer 28 of the material in a spaced relationship preventing excessive expansion of the top layer from the bottom layer when the fluid 52 contained in the apparatus 10 is caused to flow into the tongue bladder 22.

The plurality of wall sections formed by the clefts 62, 64 in the tongue bladder interior 66 also serve as flow restriction devices that impede the free flow of the fluid 52 through the interior of the tongue bladder. The spaces or openings 68 formed between the ends of adjacent wall segments formed by the clefts 64 have cross sectional areas that are specifically dimensioned and calibrated to limit the rate of fluid flow through the openings 68. When a force from foot movement in the shoe 12 is exerted on the bottom layer 28 of the tongue bladder 22, the interior volume 66 of the bladder is caused to decrease in the area of the force exerted. The decrease in the tongue bladder interior volume 66 will cause the fluid 52 to flow through the fluid channel 42 from the bladder interior. If an appreciable amount of the fluid is allowed to flow out of the bladder at the instant a force is exerted on the bladder due to foot movement, it would significantly decrease the ability of the tongue bladder to cushion the foot in the shoe. By providing the plurality of wall segments formed by the clefts 62, 64 in the interior volume 66 of the tongue bladder 22, the free flow of fluid from the bladder interior 66 through the channel 42 is restricted by the wall segments. As a result, the fluid 52 is prevented from flowing quickly out of the tongue bladder interior volume 66 on exertion of a force on the bladder and the bladder retains a portion of the fluid in its interior and thereby retains its ability to cushion the foot in the shoe from the force exerted.

The calibrated cross sectional areas of the openings 68 between adjacent wall segments formed by the plurality of clefts 62, 64 also control the rate of fluid flow through the interior 66 of the tongue bladder 22 to maintain a portion of the fluid 52 in an area of the bladder interior where a force from foot movement is exerted, thereby maintaining the cushioning for the foot in this area of the bladder. The flow of fluid from the area of the tongue bladder interior subjected to the force of foot movement, through the opening 68 between adjacent wall segments formed by the clefts 62, 64, to other areas of the tongue bladder interior 66 causes the expansion of the bladder in those other areas. The expansion of the other areas of the bladder results in these areas exerting a reactive force on the instep area of the shoe wearer's foot, thereby distributing the force of foot movement over a greater area of the foot instep and decreasing the magnitude of the force on the foot.

Like the tongue bladder 22, the forefoot bladder 24 also has a plurality of clefts 72 formed in the top layer of barrier material 32 covering the bladder. The forefoot bladder clefts 72 are formed in the top layer 32 in much the same manner as that of the tongue bladder. The forefoot bladder clefts 72 extend downward from the top layer of barrier material 32 into the interior volume 74 of the forefoot bladder to the bottom layer 34 of barrier material. Each of the forefoot clefts 74 are formed as indentations or depressions in the top layer 32 of material. Each of the clefts 72 have set lengths arranged end-to-end in rows that extend laterally across the forefoot bladder 24, and are arranged side-by-side in columns that extend longitudinally across the top layer of the bladder. The depressions of the clefts 72 extend downward below the top layer 32 of barrier material, through the fluid 52 filling the interior volume 74 of the forefoot bladder, and the bottoms of each of the clefts 72 are secured to the bottom layer 34 of material. The bottoms of the clefts may be sealed to the bottom layer of material by adhesives, by radio frequency welding, or by other equivalent methods.

By forming the clefts 72 in the top layer 32 of the forefoot bladder in the manner described above, and by arranging the plurality of forefoot clefts 72 in an array of rows extending laterally across the bladder and of columns extending longitudinally across the bladder, the rows of clefts form lateral fold lines extending across the top layer 32 of the forefoot bladder 24. The fold lines formed by the clefts 52 facilitate the folding or bending of the forefoot bladder 24 along the fold lines formed by the clefts. This enables the forefoot bladder 24 to be folded over at the cleft fold lines when the forefoot area of the shoe 12 is bent in walking, running or other activities.

In addition to forming lateral fold lines across the forefoot bladder 24, the plurality of clefts 72 form wall segments having opposite sides and opposite ends in the interior volume 74 of the bladder. The wall segments formed by each of the clefts 72 in the interior of the forefoot bladder 74 divide the interior volume into separate areas and secure the top layer 32 of barrier material to the bottom layer 34 of material in a spaced relationship preventing excessive expansion of the top layer from the bottom layer when the fluid 52 contained in the apparatus 10 is caused to flow into the forefoot bladder.

The plurality of wall sections formed by the clefts 72 in the forefoot bladder interior 74 also serve as flow restriction devices that impede the free flow of the fluid through the interior of the forefoot bladder. The spaces or openings 76 between the ends of adjacent wall segments formed by the clefts 72 have cross sectional areas that are predetermined or calibrated to limit the rate of fluid flow through the openings. When a force from foot impact is exerted on the top layer 32 of the forefoot bladder 24, the interior volume 74 of the bladder is caused to decrease. The decrease in the forefoot bladder interior volume 74 will cause the fluid 52 to flow through the channel 42 from the bladder interior. If any appreciable amount of the fluid is allowed to flow out of the bladder at the instant a footstep force is exerted on the bladder, it would significantly decrease the ability of the forefoot bladder to cushion the foot against footstep shocks. By providing the plurality of wall segments formed by the clefts 72 in the interior volume 74 of the forefoot bladder, the free flow of fluid from the bladder interior 74 through the channel 42 is restricted by the wall segments. As a result, the fluid is prevented from flowing quickly out of the forefoot bladder interior volume 74 and the bladder retains a portion of the fluid in its interior and thereby retains its ability to cushion foot fall shocks.

The calibrated or predetermined cross sectional areas of the openings 76 between adjacent wall segments formed by the plurality of clefts 72 also control the rate of fluid flow through the interior of the forefoot bladder 24 to maintain a portion of the fluid in an area of the bladder interior where a force from footstep impact is exerted, thereby maintaining the cushioning and support for the foot in this area of the bladder. The flow of fluid from the area of the forefoot bladder interior subjected to the force of foot step impact, through the openings 76 between adjacent wall segments formed by the clefts 72, to other areas of the bladder interior causes the expansion of the bladder in those other areas. The expansion of the other areas of the bladder results in these areas exerting a reactive force on the bottom of the shoe wearer's foot, thereby distributing the force of footstep impact over a greater area of the bottom of the forefoot area of the foot and decreasing the shock of foot impact.

In viewing FIG. 4, it can be seen that as pressure is exerted on the tongue bladder 22, a portion of the fluid 52 contained in the bladder will be forced through the channel 42 to the forefoot bladder 24, causing the forefoot bladder to expand out of a plane generally defined by the overlapping material layers 32, 34. Also, as a pressure is exerted on the forefoot bladder 24, the pressure will force a portion of the fluid 52 contained in the bladder to flow through the conduit 42 to the tongue bladder 22, causing the tongue bladder to expand out of the plane generally defined by the pair of overlapping layers 32, 34. The forces exerted by the apparatus 10 are limited to the areas of the foot instep and forefoot surrounded by the tongue bladder 22 and forefoot bladder 24. In this manner, the fluid 52 is permitted to flow back and forth between the tongue and forefoot bladders 22, 24 causing the bladders to expand and exert a reactive force on the instep area of the foot and the forefoot area of the foot distributing forces exerted on the foot due to footstep impact and providing a continuously changing custom fit of the shoe around the shoe wearer's foot.

Figure 2:
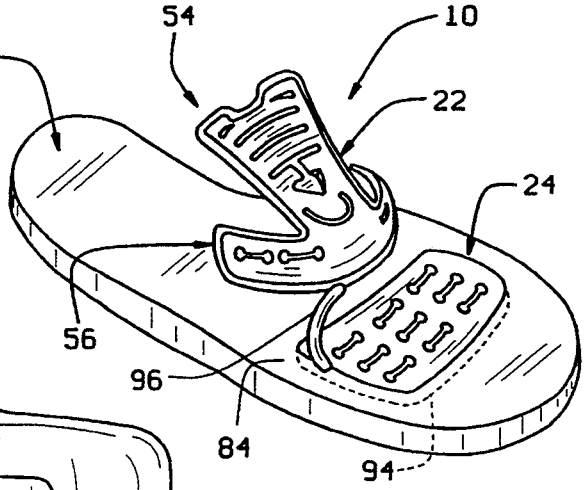
FIG. 2 is a schematic representation of the apparatus of the invention shown positioned relative to the shoe sole with the shoe upper removed.
Figure 3:
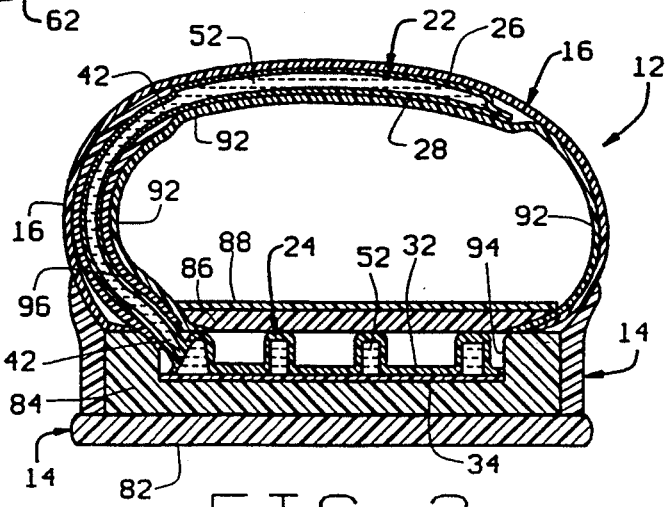
FIG. 3 is an elevation view, in cross section, of the apparatus of the invention taken along the line 3—3 of FIG. 1.

FIGS. 1, 2 and 3 show one manner of assembling the apparatus 10 of the invention in a shoe. In the operative environment shown in FIGS. 1–3, the shoe 12 is generally comprised of an outsole 82, a midsole 84, a sock insert 86, and a sock liner 88. Also shown in FIG. 13 are the inner layer 92 and outer layer 16 of the upper material of the shoe. As seen in FIG. 3 and as shown schematically in FIG. 2, the top surface of the shoe midsole 84 is formed with a cavity 94 having a configuration to receive the forefoot bladder 24 in the relative position of the bladder to the midsole shown in FIG. 2. The fluid conducting conduit 42 extends from the left hand side of the forefoot bladder 24 as viewed in FIG. 3, up across the left side of the shoe upper 16 between the exterior layer of upper material and the interior layer 92 of upper material. A rigid, hollow tube 96 is provided around the fluid conducting channel 42 communicating the forefoot bladder 24 with the tongue bladder 22. The tube 96 has a slight curvature that prevents the flexible material of the fluid conducting channel 42 from crimping or pinching closed as the channel bends from the forefoot bladder 24 located in the shoe midsole 84 to the tongue bladder 22 located in the instep and tongue areas of the shoe upper 16. The vamp chamber 56 of the tongue bladder 22 is secured in the instep area of the shoe 12 between the interior and exterior layers 92, 16 of the shoe upper material. The vamp chamber 56 of the tongue bladder 22 may be secured in the upper portion of the shoe 12 by adhesives, by stitching, or by other equivalent methods. The tongue chamber 54 of the tongue bladder 22 is secured in the shoe tongue 18 between interior and exterior layers of material that form the tongue. Although not shown, the tongue chamber 54 of the bladder 22 may be secured in the interior of the shoe tongue 18 by adhesives, by stitching or by other equivalent methods.

The sock insert 86 is shown laid in the interior of the shoe 12 covering over the forefoot bladder 24 positioned in the cavity 94 of the shoe midsole 84. The material of the sock liner 88 is adhered to the top surface of the sock insert 86 as is conventional. In alternate embodiments of the invention, a cavity is formed in the underside of the sock insert 86 to receive the forefoot bladder 24, and the forefoot bladder 24 is laid flat on the top surface of the shoe midsole 84 in assembling the apparatus of the invention 10 in the shoe 12.

While the present invention has been described by reference to specific embodiments, it should be understood that modifications and variations of the invention may be constructed without departing from the scope of the invention defined in the following claims.

What is claimed is:

1. A reactive energy apparatus providing cushioning, support, and a custom fit to a shoe having an upper with a tongue and an instep area and a shoe sole with a forefoot area located on the sole beneath a forefoot area of a shoe wearer's foot, the apparatus comprising:

first means located on the tongue of the shoe upper for containing a fluid on the tongue of the shoe upper;

second means located on the forefoot area of the shoe sole for containing a fluid on the forefoot area of the shoe sole;

means for communicating fluid between the first fluid containing means and the second fluid containing means, the means including at least one fluid conducting conduit extending between the first and second fluid containing means, the conduit extends through a hollow tube, the tube extends through portions of both the shoe upper and the shoe sole, and the tube forms a protective cover over the conduit and protects the conduit from collapsing and closing due to external forces exerted on the tube; and, a fluid filling the first fluid containing means and, the second fluid containing means, a portion of the fluid filling one of the first and second fluid containing means being caused to be communicated by the fluid communicating means to the other of the first and second fluid containing means in response to a force being exerted on the one of the first and second fluid containing means.

2. The apparatus of claim 1, wherein:

the first fluid containing means includes at least one fluid filled bladder, the bladder having two sections, with one section of the bladder being positioned on the shoe tongue and a second section of the bladder being positioned on a vamp area of the shoe upper.

3. The apparatus of claim 1, wherein:

the first fluid containing means includes at least one hollow tongue bladder on the tongue of the shoe, the tongue bladder having at least one flexible sidewall enclosing an interior volume of the tongue bladder;

the second fluid containing means includes at least one hollow sole bladder on the forefoot area of the shoe sole, the sole bladder having at least one flexible sidewall enclosing an interior volume of the sole bladder;

the fluid communicating means includes at least one fluid conducting conduit extending between the tongue bladder and the sole bladder, the conduit extending through portions of both the shoe upper and the shoe sole; and, the fluid filling both the tongue and sole bladders, a portion of the fluid filling one of the tongue and sole bladders being caused to be communicated by the conduit to the other of the tongue and sole bladders in response to a force being exerted on the one of the tongue and sole bladders.

4. The apparatus of claim 3, wherein:

the tongue bladder has a second flexible Sidewall lying adjacent the one flexible sidewall, the one sidewall and second sidewall enclosing the interior volume of the tongue bladder therebetween; and, a plurality of clefts are formed in the one sidewall and extend into the tongue bladder interior volume through the fluid to the second sidewall, each cleft has a bottom joined to the second sidewall thereby connecting the one sidewall in a spaced relation to the second sidewall with the fluid filling the interior volume therebetween.

5. The apparatus of claim 4, wherein:

the plurality of clefts are arranged in at least one line extending across the tongue bladder, the line of clefts form a fold line across the tongue bladder that enables folding the tongue bladder across the fold line.

6. A reactive energy apparatus providing cushioning, support, and a custom fit in a shoe having an upper with a tongue and an instep area and having a shoe sole with a forefoot area located on the sole beneath a forefoot area of a shoe wearer's foot, the apparatus comprising:

a first fluid containing bladder located in the tongue and the instep area of the shoe upper, the first bladder being formed of a pair of overlapping layers of a flexible, fluid tight material that come together along a peripheral boundary of the first bladder, the peripheral boundary of the first bladder having a configuration that forms the first bladder in a tongue chamber and an instep chamber that are extensions of each other and are located on the tongue and on the instep of the shoe upper, respectively, the tongue chamber has a configuration defined by the first bladder peripheral boundary that extends the tongue chamber longitudinally from the instep chamber across an instep area of a shoe wearer's foot along the shoe tongue, and the instep chamber has a configuration defined by the first bladder peripheral boundary that extends the instep chamber from the tongue chamber around opposite lateral sides of the tongue chamber and around opposite lateral sides of an instep area of a shoe wearer's foot;

a second fluid containing bladder located in the forefoot area of the shoe sole; and, at least one fluid conducting conduit extending between the first and second fluid containing bladders, the conduit extending from the first fluid bladder through portions of both the shoe upper and the shoe sole to the second fluid bladder, and means are provided in both the shoe upper and the shoe sole for protecting the conduit from collapsing and closing due to external forces exerted on the conduit.

7. The apparatus of claim 6, wherein:

the means for protecting the conduit from collapsing and closing includes a hollow tube that extends through the shoe upper and the shoe sole, and the conduit extends through the hollow tube.

8. The apparatus of claim 6, wherein:

the tongue chamber has an interior volume enclosed between the pair of overlapping layers of flexible, fluid tight material of the first bladder, the interior volume is filled with a fluid, and a plurality of interior wall segments are spatially arranged inside the interior volume of the tongue chamber, each of the wall segments is connected between the pair of overlapping layers of flexible, fluid tight material and each of the wall segments extends laterally through the tongue chamber interior volume thereby providing greater resistance to a flow of the fluid longitudinally through the tongue chamber interior volume than laterally through the tongue chamber interior volume.

9. The apparatus of claim 8, wherein:

each of the wall segments extending laterally across the tongue chamber interior volume forms a lateral fold line in the tongue chamber that facilitates folding of the tongue chamber over the fold line.

10. The apparatus of claim 8, wherein:

the instep chamber has an interior volume enclosed between the pair of overlapping layers of flexible, fluid tight material of the first bladder, the instep chamber interior volume is continuous with the tongue chamber interior volume and is filled with the fluid, and the instep chamber interior volume extends from opposite lateral sides of the tongue chamber interior volume around opposite lateral sides of an instep area of a shoe wearer's foot.

11. The apparatus of claim 6, wherein:

the shoe sole has a cavity in the forefoot area of the sole and the second bladder is received in the cavity, the shoe upper has inner and outer layers of material and the fluid conduit extends from the second bladder out of the cavity and between the inner and outer layers of material of the shoe upper to the first bladder, and the first bladder is secured in the tongue and instep area of the shoe upper between the inner and outer layers of material of the shoe upper.

12. The apparatus of claim 11, wherein:

the means for protecting the fluid conduit from collapsing and closing includes a hollow tube around the fluid conduit, the tube extends from the second bladder out of the cavity and between the inner and outer layers of material of the shoe upper to the first bladder.

13. A shoe containing a reactive energy apparatus that provides cushioning support and a custom fit to the shoe, the shoe comprising:

a shoe sole having top and bottom surfaces and laterally spaced medial and lateral side edges that extend longitudinally around the sole from a back end of the sole to a front end of the sole, the sole having a forefoot area positioned adjacent the sole front end underlying the ball of a foot inserted into the shoe, the sole having a heel area positioned adjacent the sole back end underlying the heel of a foot inserted into the shoe, and the sole having an arch area positioned between the forefoot and heel areas underlying the arch of a foot inserted into the shoe;

a shoe upper connected to the shoe sole, the upper having opposite medial and lateral sides that are connected to the medial and lateral side edges of the shoe sole, the upper having an instep area positioned overlying the instep of a foot inserted into the shoe and the upper having a tongue extending longitudinally from the instep area of the upper, the tongue being defined by laterally spaced medial and lateral edges of the tongue that extend longitudinally along opposite sides of the tongue from the instep area of the upper to a top edge of the tongue that extends laterally between the medial and lateral edges of the tongue;

a first fluid containing bladder located on the tongue and the instep area of the shoe upper;

a second fluid containing bladder located on the forefoot area of the shoe sole;

at least one fluid conducting conduit having a length extending directly from the first fluid containing bladder through the shoe upper to the second fluid containing bladder and providing direct fluid communication between the first and second fluid containing bladders without branching off to other areas of the shoe upper or shoe sole;

the first fluid containing bladder has a tongue chamber and an instep chamber, the tongue chamber is located on the tongue of the shoe upper above the instep area of the shoe upper and within the opposite medial and lateral edges and top edge of the tongue, and the instep chamber is located at the instep area of the shoe upper below the tongue and extending laterally beyond the opposite medial and lateral edges of the tongue;

the fluid conducting conduit extends from the instep chamber of the first fluid containing bladder to the second fluid containing bladder; and a protective tube extends through the shoe upper from the instep area to the forefoot area of the shoe sole, and the fluid conduit extends through the protective tube.

14. The shoe of claim 13, wherein:

the second fluid containing bladder is isolated on the forefoot area of the shoe sole and does not extend to the arch and heel areas of the sole.

15. The shoe of claim 13, wherein:

the tongue chamber has a lateral width that extends laterally across the tongue of the shoe upper between the medial and lateral edges of the tongue, and the instep chamber has a lateral width that is larger than the tongue chamber lateral width and extends the instep chamber beneath the opposite medial and lateral edges of the tongue and around the opposite medial and lateral sides of the shoe upper.

16. The shoe of claim 13, wherein:

the tongue chamber has a longitudinal length that is larger than a lateral width of the tongue chamber, and the instep chamber has a longitudinal length that is smaller than a lateral width of the instep chamber.

17. The shoe sole of claim 13, wherein:

a cavity is formed in the forefoot area of the shoe sole forward of the arch area of the sole and spaced rearward of the sole front end, and the second fluid bladder is located entirely in the cavity.

* * * * *